United States Patent [19]

Goheen et al.

[11] 4,145,246

[45] Mar. 20, 1979

[54] PROCESS FOR MAKING HIGH-STRENGTH, HIGH-YIELD SULFITE-MODIFIED THERMOMECHANICAL PULP AND A LINERBOARD COMPOSITION PRODUCED THEREFROM

[75] Inventors: David W. Goheen, Camas; Michael D. Fahey, Vancouver, both of Wash.

[73] Assignee: Crown Zellerbach Corporation, San Francisco, Calif.

[21] Appl. No.: 706,362

[22] Filed: Jul. 19, 1976

[51] Int. Cl.[2] ..... D21B 1/30

[52] U.S. Cl. ..... 162/23; 162/24; 162/28; 162/71; 162/83; 162/142

[58] Field of Search ..... 162/24, 26, 28, 83, 162/142, 71, 27, 23

[56] References Cited

U.S. PATENT DOCUMENTS

| | | | |
|---|---|---|---|
| 2,425,024 | 8/1947 | Beveridge et al. | 162/28 |
| 2,454,533 | 11/1948 | Walter | 162/26 |
| 3,597,310 | 8/1971 | Sumi et al. | 162/26 |
| 3,808,090 | 4/1974 | Logan et al. | 162/26 |
| 3,873,412 | 3/1975 | Charters et al. | 162/26 |

FOREIGN PATENT DOCUMENTS

| | | | |
|---|---|---|---|
| 460517 | 10/1949 | Canada | 162/27 |
| 546513 | 9/1957 | Canada | 162/28 |
| 810140 | 3/1959 | United Kingdom | 162/26 |

OTHER PUBLICATIONS

Casey "Pulp & Paper," vol. II (1960), pp. 340, 341.

"Paper Trade Journal," vol. 159, No. 6, (Jun. 15, 1975), pp. 59, 60.

*Primary Examiner*—Richard V. Fisher

*Assistant Examiner*—Peter Chin

*Attorney, Agent, or Firm*—Jerome S. Marger

[57] ABSTRACT

A high-strength, high-yield sulfite-modified thermomechanical pulp is formed by subjecting lignocellulose to multistage mechanical attrition, the first stage being conducted at elevated temperature and pressure and the second stage being run under atmospheric conditions. A sulfite chemical is added to the lignocellulose prior to the second stage, the lignocellulose being sulfonated so that a percent bound sulfur level of at least about 0.15% is provided. A novel linerboard composition is unexpectedly produced employing replacement quantities of the above described pulp.

29 Claims, 4 Drawing Figures

PROCESS FOR MAKING HIGH-STRENGTH, HIGH-YIELD SULFITE-MODIFIED THERMOMECHANICAL PULP AND A LINERBOARD COMPOSITION PRODUCED THEREFROM

BACKGROUND OF THE INVENTION

This invention generally relates to a process for making a novel high-strength, high-yield sulfite-modified thermomechanical pulp (SMTMP) which can be used in the production of a novel, relatively low cost, commercial-grade linerboard composition, having at least the critical level of bursting strength required in the market place, and which is then formed into a high-strength boxboard composition. The above linerboard composition unexpectedly includes the use of SMTMP, as hereinafter described, in replacement quantities.

Boxboard is the structural paperboard material employed in making commercial cartons and is typically constructed of an inner layer, usually formed of a corrugating medium, and two thin outer layers of linerboard. The linerboard layers are in general formed predominantly of chemical pulp which has a low yield (less than 50%). Due to the increased costs of wood pulp in recent years, the manufacturing costs of linerboard, and correspondingly the cost of boxboard, have sky-rocketed. Linerboard is sold at a given market price if it meets the minimum strength specification, namely, bursting strength, or percent mullen, i.e., a determination of the ability of the linerboard sheet to resist sheet failure when subjected to the bursting or punching action of a solid object. In the past, when more than about 15% of the chemical pulp used in linerboard was replaced by a more economical, high-yield substitute, such as groundwood and the like, the bursting strength of the sheet dropped below the acceptable minimum commercial level. Thus, these processes merely provide a "filler" material for use in linerboard in conjunction with chemical pulp, but they do not provide a true "replacement" fiber.

A major type of filler pulp known to the prior art is refiner mechanical pulp used in applications requiring a minimum degree of bursting strength, such as newsprint or various types of printing paper. In recent years, refiner mechanical pulp, and more specifically, thermomechanical pulp, produced by multistage refining of undelignified lignocellulose has been used for this purpose.

In the thermomechanical pulp process, for example, described in U.S. Pat. No. 2,008,898 to Asplund, wood chips are presteamed to a suitable temperature above 100° C. and at a corresponding pressure and are then refined at these conditions and subsequently further refined at atmospheric temperature and pressure. As described in both an article by Ingemar Bystedt entitled "Thermomechanical Pulping", appearing in the brochure "Pulp and Paper Mission to North America 1973", and in an invited paper given at the ESPRA 9th European meeting at San Remo, Italy, in April 1974, by Michael T. Charters of the C. E. Bauer Company called "Thermomechanical Pulping", when the initial refining step takes place at a temperature exceeding 140° C., the lignin portion of the undelignified lignocellulose is softened so that the wood structure is broken in the lignin-rich middle lamella layer and the cellulose fibers are easily separated from each other in a substantially undamaged condition at a relatively low consumption of energy. However, subsequent fibrillation of the pulp to make it useful in low burst strength printing paper grades requires an unusually large amount of energy since, when the fibers are released intact, they are coated with the softened lignin which, on cooling, reverts to a glassy state and becomes an obstacle to the subsequent fibrillation of the separated fibers. Further refining also causes substantial fiber length reduction and minimizes strength properties. Charters suggests that the lignin coating encompassing the fibers can be made more easily refinable for purposes of fibrillation by imparting large amounts of power (55 HPD/T) during high-temperature refining to achieve not only fiber separation but also some disassembly of the fiber layers themselves, thereby exposing the cellulose-rich inner surfaces to further mechanical treatment. This also results in significant average shortening of the fibers and a corresponding lowering of strength properties. On the other hand, when the chips are refined at a lesser temperature (120°–140° C.), employing lesser amounts of power, separation takes place by fracturing the fibers predominantly in the outer layers of the secondary fiber wall which renders the fibers more accessible to fibrillation. Since energy consumption is substantially reduced when the refining pressure is lowered to about 15–35 p.s.i.g., which corresponds to a temperature of about 120°–140° C., this is the preferred method of producing refiner mechanical pulp.

Pulp usable as refiner groundwood can also be produced in cases where the fibers are coated with lignin employing digesting chemicals such as sodium sulfite under conditions such that the lignin coating will be substantially dissipated. For example, Bystedt provides that the thermomechanical pulp process conducted at temperatures exceeding 140° C. be modified by impregnation of the chips with chemicals followed by extended vapor-phase digestion removal of surface lignin, prior to defibration, to produce various grades of semichemical and semimechanical pulps for printing papers, corrugating medium, board, etc. U.S. Pat. No. 3,773,610 to Shouvlin teaches a similar multistage process in which the lignin coating the fibers is subsequently extracted in a digester or bleach tower. U.S. Pat. No. 3,597,310 to Sumi et al. also contemplates extensive chemical treatment in the process for mechanically defibering wood chips at or above the lignin glass transition temperature.

Other methods for making refiner groundwood for use in newsprint contemplate multi-stage treatment (with chemicals) of lignocellulose under conditions such that the level of added chemical employed will act only to bleach the fibers causing a minimum degree of sulfonation to occur which would be insufficient to improve strength properties.

In these multi-stage refining processes, the fibers are treated under conditions which are too mild to sufficiently modify the lignin for use as replacement fibers in linerboard. For instance, U.S. Pat. No. 3,388,037 (U.S. '037) and U.S. Pat. No. 3,446,699 (U.S. '699) both to Asplund, describe a process in which a sulfite chemical is added to wood chips in relatively low amounts (1.66% by weight based on O.D. lignocellulose in U.S. '699). In U.S. '037, sodium sulfite is supplied as a bleaching agent only, in an amount sufficient to maintain a brightness level required for newsprint.

U.S. Pat. No. 3,661,328 to Leask and U.S. Pat. No. 2,454,532 and U.S. Pat. No. 2,454,533 to Walter, treat the lignocellulose for an insufficient residence time period to enable the requisite softening of the lignin so that insufficient sulfonation will result on treatment with a sulfite chemical. More specifically, the Leask process limits the conditioning time to less than one minute and provides for the introduction of only 1% to 2% sodium sulfite, and also at a temperature and pressure insufficient to soften the lignin, while Walter, in U.S. Pat. No. 2,454,532, operates the high temperature refiner to minimize or avoid incidental chemical action on the lignocellulose employing a residence time of 40 seconds, or less.

Another approach to solving the high cost problems associated with conventional linerboard, as described in U.S. Pat. No. 3,873,412 to Charters et al., includes a process for producing filler pulp for use in the manufacture of kraft-type products. In this process, the proportion of filler pulp mixed with conventional kraft pulp is about 5% to about 25% of the total pulp furnish. However, the pulp actually employed by Charters et al. in this process, from a practical standpoint, has a filler content of only about 10–15%, since more than that amount would probably produce a linerboard sheet having a substandard burst strength.

SUMMARY OF THE INVENTION

In contrast to the prior art processes previously described, the subject process relates to the formation of an improved, low cost SMTMP having unexpectedly high-strength properties and a low-cost linerboard product therefrom, the linerboard having a percent mullen of at least 80%, and including at least 25% by weight of high-yield (greater than 85% by weight) SMTMP. The SMTMP formation process is conducted by initially imparting mechanical attritional forces to undefibered lignocellulose which has been subjected to an elevated temperature and corresponding pressure for a period of time sufficient to soften the lignin portion of the lignocellulose causing substantial fiber separation to occur in the middle lamella layer so that the fibers remain essentially intact with a lignin coating on their outer surfaces. The power imparted to the undefibered lignocellulose by the initial mechanical attritional forces is sufficient to provide substantial fiber separation in the middle lamella without causing significant disassembly of the cellulose layers which form the fibers themselves.

A sulfite chemical is added to the lignocellulose prior to, during, or subsequent to the initial mechanical attrition step so that a substantial quantity of carbon-to-sulfur covalent bonds are created when the sulfite interacts with the lignin. The degree of sulfonation is controled in a manner adequate to produce SMTMP having a percent bound sulfur level of at least about 0.15% by weight, based on the total weight of lignocellulose employed in producing said SMTMP. However, the sulfonation step is at the same time limited to prevent dissipation of the lignin content of the SMTMP to a point where the yield is detrimentally affected. The sulfite-treated pulp is then subjected to a further mechanical attrition step, generally by refining at high consistency, atmospheric temperature and pressure conditions, to form SMTMP having a desired freeness and average fiber length, as hereinafter described. An aqueous linerboard furnish is then prepared, preferably combining SMTMP with chemical pulp, which includes at least 25% by weight of SMTMP replacement fibers. This SMTMP-containing linerboard furnish is capable of being formed into a linerboard composition having the requisite burst strength while, at the same time, retaining the ability to properly drain during formation of the linerboard web on a foraminous surface.

DETAILED DESCRIPTION OF THE INVENTION

Figure 1A:
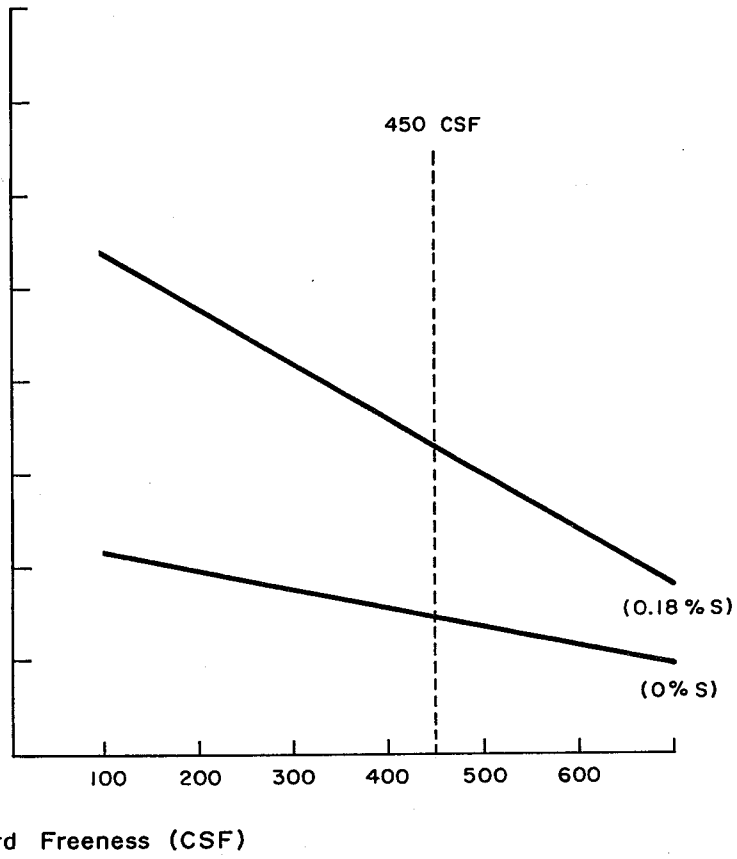
FIGS. 1 and 1A are graphical representations of the strength versus freeness relationships for SMTMP having varying bound sulfur levels as compared to their untreated counterparts (see Example 1).

Linerboard sheets are produced having the level of bursting strength required by commercial standards even though a substantial amount of the low-yield high-cost chemical pulp has been replaced by high-yield SMTMP. More specifically, a standard 42-pound-per-1,000 $ft^2$ basis weight commercial-grade linerboard sheet, in general, must have a percent mullen of at least 80%, since this is the standard bursting strength required for a given basis weight linerboard sheet being shipped in interstate commerce, according to federal law. Since bursting strength is the sole criteria set by federal government regulations, it is the major basis on which linerboard is bought and sold. The percent mullen test for linerboard is described in TAPPI T-807.

The linerboard composition of this invention is formed from a furnish containing a replacement quantity of SMTMP. To a major extent, the bursting strength of a linerboard sheet is inversely proportional to the average yield of a given pulp furnish. Thus, prior art linerboard sheets are unable to retain the requisite bursting strength when more than a small amount of high-yield pulp filler material is employed in the sheets. Conversely, in the process of the present invention, at least 25% by weight SMTMP, or greater, is employed as a replacement for chemical pulp in the linerboard furnish, while at the same time maintaining adequate bursting strength. More particularly, it is preferred that at least 30%, and more preferably at least 40%, of the chemical pulp in the linerboard furnish be replaced by SMTMP. Correspondingly, up to about 75% by weight chemical pulp can be readily combined with the SMTMP in a given pulp furnish. It is preferred, however, that up to about 70% by weight, and more preferably up to about 60% by weight of chemical pulp, be used in making the subject linerboard composition.

Another important parameter of this invention is yield, i.e., the weight of SMTMP formed divided by the weight of lignocellulose starting material X 100. The yield must be high enough to provide a significant cost savings in order to justify the expense of employing a chemical modification technique in a commercial linerboard process. Accordingly, the conditions for preparing SMTMP must be such that a substantial amount of lignin is not dissipated when the lignocellulose is treated with sulfite chemical so that a yield of greater than about 85%, and preferably a yield greater than about 90%, is maintained.

A sulfite chemical is added to the lignocellulose under the conditions hereinafter described so that a substantial quantity of carbon-to-sulfur bonds are formed on sulfonation of lignin. Accordingly, the degree of sulfonation of the lignin is controled in a manner adequate to produce SMTMP having a percent bound sulfur of at least about 0.15% by weight, based on the total weight of lignocellulose employed in producing the SMTMP, but limited to prevent dissipation of the lignin content of the SMTMP to the point where the yield is detrimentally affected. Furthermore, it is preferred that the sulfonation step be maintained so that the bound sulfur level is at least about 0.25% by weight, and more preferably at least about 0.40% by weight, to insure optimum carbon-to-sulfur covalent bond formation. A percent bound sulfur up to about 0.70%, and preferably up to about 0.50%, can generally be effectively employed without causing a detrimental effect on the SMTMP yield.

The SMTMP formation process is conducted by initially imparting mechanical attritional forces to undefibered lignocellulose, preferably in the form of wood chips, in a work space, which has been subjected to an elevated temperature and corresponding pressure for a residence time period sufficient to soften the lignin so that substantial fiber separation occurs in the middle lamella layer of the lignocellulose so that the fibers remain essentially intact with a lignin coating on their outer surfaces. The elevated temperature and pressure is generally achieved by employing steam at an elevated temperature and pressure which correspondingly raises the temperature of the lignocellulose in the work space to a predetermined level. The residence time period for preheating the lignocellulose is adjusted so that the desired lignin-softening effect is provided at a given temperature and pressure condition. Generally, a pressure of at least 30 p.s.i.a., and preferably at least 50 p.s.i.a., and a corresponding elevated temperature, is maintained in the work space in order to achieve the desired level of lignin softening during the mechanical attrition step. At the same time, a preferred residence time period for preheating the lignocellulose of at least about 1.5 minutes, and more preferably at least about 2.0 minutes in the indicated temperature and pressure range, is provided depending on the time required to accomplish the above lignin-softening effect. As a practical matter, although preheating may continue for a longer time interval without damaging the lignocellulose, the residence time for preheating is typically limited to about 5 minutes, and preferably about 4 minutes in duration. A sulfite chemical is added prior to, during, or subsequent to the hereinafter described initial mechanical attrition step in a manner such that a sulfonation reaction occurs and the previously set forth bound sulfur level is reached. This sulfonation step can be carried out employing various techniques such as by subjecting undefibered lignocellulose (a) to a sulfite chemical addition step prior to softening the surface lignin, generally in a preheater with steam, then providing the designated pressure and temperature for a predetermined period of time, followed by initial mechanical attrition of the lignocellulose at elevated temperature and pressure conditions, or (b) injecting the sulfite chemical directly into the initial mechanical attrition zone containing undefibered lignocellulose at the above elevated temperature and pressure conditions, or (c) post-sulfonation of untreated thermomechanical pulp with a sulfite chemical. In any case, the lignocellulose is sulfonated so that the requisite quantity of covalent carbon-to-sulfur bonds are created during sulfonation.

The sulfite chemical is generally added as a solution. However, free $SO_2$ may be reacted with the lignocellulose, as described below, in either gaseous or liquid form. If $SO_2$ is employed in a gaseous state, it is preferred that post-treatment step be conducted subsequent to the initial mechanical attrition step and prior to further mechanical attrition of the pulp.

When the sulfite chemical is a sulfite solution, it is generally in the form of an aqueous solution of a water-soluble sulfite such as sodium sulfite, ammonium sulfite, potassium sulfite, and the like. However, due to factors of both costs and availability, sodium sulfite is the preferred sulfite chemical.

It is desirable to sulfonate the lignocellulose, when employing the process of this invention, under alkaline pH conditions to maximize the modification effect of the lignin by the sulfite. More specifically, a pH of at least about 8 up to a pH of about 11 is typically maintained during the lignin-softening and/or sulfonation steps, respectively. In general, a sulfite chemical can be employed alone, or in combination with either a carbonate or a hydroxide compound, to provide an alkaline environment for sulfite modification. For example, if sodium sulfite is used as the lignin modifier, it can be employed by itself, or in conjunction with sodium carbonate or sodium hydroxide.

In the case of a sulfite chemical added as in aqueous solution, from about 4.0% and preferably from about 5% by weight, based on the percent by weight of lignocellulose, can generally be employed to achieve the requisite bound sulfur level previously described herein and, although up to about 200% by weight (O.D.) of the sodium sulfite chemical can be used, up to about 25% (O.D.) by weight is preferred.

Typically, any device capable of imparting attrition at the previously designated temperature and pressure conditions can be employed as a means for conducting the initial mechanical attrition step. Generally, however, steam-pressured disc-refining, and preferably double-disc-refining, is employed in the initial attrition step. For example, a Bauer Model No. 418 pressured double-disc refiner, made by the Bauer Bros. Co. of Springfield, Ohio, can be used herein.

The power to which the undefibered lignocellulose is subjected during the initial mechanical attrition step should be sufficient to separate lignin-coated fibers in the middle lamella layer from the lignocellulose-softened lignin matrix without causing significant disassembly of the cellulose layers which form the fibers themselves. To accomplish the desired fiber separation, the power imparted to the undefibered lignocellulose during the initial mechanical treatment is typically maintained at less than about 50 HPD/T, and preferably less than about 35 HPD/T.

After the sulfite modification step and first mechanical attrition step are completed by any of the above described methods, the sulfite-treated pulp is subjected to a second mechanical attrition step, conducted at substantially atmospheric temperature and pressure conditions to form the subject SMTMP. Although any mechanical attrition process which will produce SMTMP having the requisite freeness, average fiber length, etc., can be employed herein, this latter step is preferably conducted at high consistency, employing refining techniques described in U.S. Pat. No. 3,382,140 to Henderson et al. And, although a lignocellulose consistency range of generally between 10% and about 60% is contemplated by Henderson et al., a high lignocellulose consistency level of from about 20% and up to about 35% is preferred herein in conducting the second mechanical attrition step.

The second mechanical attrition step is conducted so that the SMTMP produced has a freeness and fiber length within the range hereinafter described. The total power used in conducting both of the mechanical attrition steps is typically from about 40 HPD/T, although a total power usage of from about 60 HPD/T is preferred. The maximum level of total power generally imparted to lignocellulose is up to about 120 HPD/T, although a total power of up to about 85 HPD/T can generally be provided without substantial detrimental effect to the freeness and fiber length of the SMTMP.

It is quite important for the average fiber length of the lignocellulose to be substantially maintained on formation of the SMTMP in order to facilitate the maintenance of an adequate bursting strength level for linerboard. Accordingly, the SMTMP, depending on the particular specie of lignocellulose starting material employed, will generally have a weighted average fiber length of at least 1.4 millimeters, and preferably at least 1.6 millimeters. TAPPI Standard 233 Su-64 sets out the basis for calculating the value of weighted average fiber length in millimeters. In Volume 55, No. 2, of the January 1972 issue of TAPPI, simplified method of calculating the average fiber length is set forth. The article, which is entitled "Fiber Length of Bauer-McNett Screen Fractions", written by J. E. Tasman, appears on page 136 of the aforementioned TAPPI publication. The simplified method should be used in computing the above weighted average fiber length values.

The ability of the linerboard sheet to properly drain during sheet formation is quite important since, if sufficient drainage does not take place, the speed of the paper machine must be reduced or the wet-formed web will not hold together on the foraminous surface. A measure of this drainage parameter is freeness, and more particularly Canadian Standard Freeness (CSF), as described in TAPPI T-27. More particularly, for most commercial linerboard machines in operation today, a Canadian Standard Freeness typically from about 150 CSF, and preferably from about 250 CSF, is provided. And, in general, a freeness of up to about 650 CSF, and preferably up to about 550 CSF, should generally be maintained as the upper freeness limit.

The pulp from the second mechanical attrition step is preferably diluted with water to form a hot, aqueous slurry (at about 75°–85° C.), at a consistency up to about 4% by weight, based on the total weight of the slurry, and is agitated for about 20 minutes to remove the latency or to stress-relieve the fibers, the process being defined as "hot disintegration".

In a preferred embodiment of this invention, a mixture of SMTMP and chemical pulp at respective high- and low-freeness levels are combined to form a composite furnish having a Canadian Standard Freeness within the above described range. For example, a high-freeness thermomechanical pulp can be combined with a low-freeness chemical pulp to produce a composite furnish having a higher bursting strength than if equal freeness mixtures, in the same weight proportions, were employed. The resultant furnish can be formed into commercial-grade linerboard sheets.

A further preferred embodiment of this invention provides for the incorporation of dry-strength additives in the modified thermomechanical pulp to further increase the burst strength of the subject linerboard sheet. The use of a dry-strength additive in conjunction with SMTMP unexpectedly provides a more pronounced effect on the bursting strength on a linerboard sheet made therefrom, as compared to the addition of a similar amount of a similar additive in linerboard made from an unmodified thermomechanical pulp-containing linerboard furnish. The amount of dry-strength additive should preferably be at least about 0.05% by weight, based on the total weight of pulp in the furnish, and more preferably at least about 0.1% by weight. Typical compounds which can be employed as dry-strength additives include polyacrylamides, cationic starches, melamine-urea resins, urea-formaldehyde resins, and the like, the most preferred compounds being the polyacrylamides. Commercially available polyacrylamide-based compounds which have been found to be useful as dry-strength additives in this invention include, for example, several polyacrylamide-based resinous materials manufactured and sold by American Cyanamide Company, Wayne, New Jersey, under the trademark "ACCOSTRENGTH", including ACCOSTRENGTH 100 UK-A and ACCOSTRENGTH 98, respectively.

The linerboard furnish is then formed into the requisite linerboard sheet, and subsequently into a standard boxboard composition by standard techniques known in the industry.

EXAMPLE 1

These experiments were conducted to demonstrate that linerboard sheet composition could be made employing SMTMP at the requisite replacement levels, while maintaining burst strength and yield, when the process of this invention is employed to form the subject SMTMP. More specifically, in one set of experiments various samples of lignocellulose, in the form of Southern pine chips, were subjected to sulfite treatment prior to an initial mechanical attrition step to produce sulfite-treated pulps and compared to their untreated counterparts (see Tables 1*a*–1*c*). In another experiment, the process was repeated with the sulfite treatment being provided during the initial mechanical attrition step. In each case, the initial mechanical attrition was imparted to the chips employing a Bauer 418 pressurized double-disc refiner, built by Bauer Bros. Company of Springfield, Ohio. The chips were presteamed at a pressure of about 75 psig with a presteaming residence time of about 2.0–2.25 minutes. Prior to pressure-refining, the chips were fed to a 560 GS Impressafiner, also made by Bauer Bros., wherein excess liquid was removed from the wood chips within the Impressafiner housing by the action of a truncated, conical feed worm which compressed the chips against the housing causing softening and separating of the fibers. In the first experiment, an aqueous sulfite solution was added to the Impressafiner. In another experiment, the sulfite chemicals were added with the refiner-eye-water. For comparison purposes, runs were conducted in which no chemical was added either to the Impressafiner or at the refiner eye.

Each of the above sulfite-treated samples were thoroughly washed, and then analyzed to determine the yield of pulp based on the original weight of oven-dried wood. This yield determination was based on the assumption there were no weight losses due to volatile materials. Yields were corrected for inorganic chemicals in cases where sulfite modification was conducted. The sulfite-treated lignocellulose was then washed, analyzed for sulfur content to determine the degree of reaction between the sulfite and the wood, and was then refined in a Bauer 415 double-disc refiner at about 1,800 rpm employing No. 24301 carbon-steel plates to form SMTMP. The SMTMP was quenched with cold water, centrifuged, and hot-disintegrated by diluting the pulp with water to form a hot, aqueous slurry, at a consistency of about 4.0% by weight, heating the same to about 70°-85° C., and agitating the mixture for about 20 minutes to remove fiber latency. The hot-disintegrated pulp was then tested for freeness, fiber length, and burst strength (% mullen).

Figure 1:
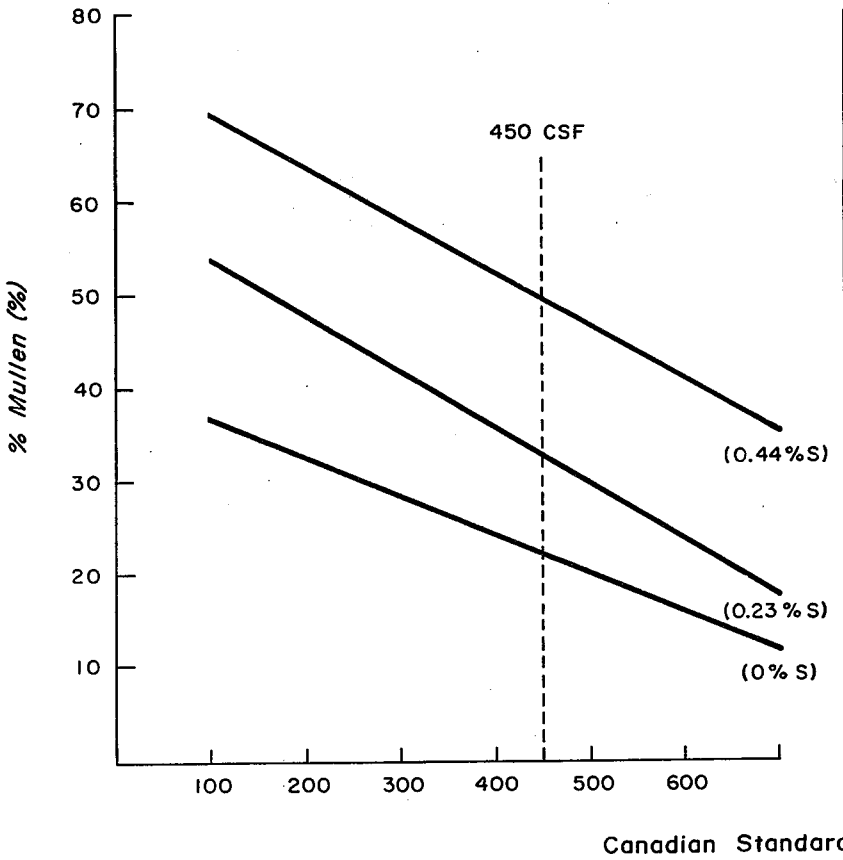

A summary of exemplary experimental data showing burst strength vs. freeness is tabulated in Tables 1*a* through 1*f* and graphically shown in FIGS. 1 and 1A. To accurately compare the burst strength of a given sample, it must be made at a similar freeness level since both properties must be present in order to achieve commercial viability. More specifically, sheet made from 100% thermomechanical pulp without chemical addition (see Tables 1*a* and 1*e*) were compared with sheet made from 100% SMTMP pulp at various bound sulfur levels (0.18% S in Table 1*e*, 0.23% S in Table 1*b*, and 0.44% S in Table 1*c*). Therefore, since the resultant sheets tested had differing burst strengths and freeness levels, respectively, the graphic representations in FIGS. 1 and 1A provide the best summary of the differences between modified and unmodified fibers, as well as modified fibers at varying chemical addition levels. Tables 1*a*-1*c* illustrate the process of the present invention, wherein sulfite chemical is added prior to the initial mechanical attrition step, while Tables 1*d* and 1*e* show the data from experiments in which the lignocellulose is treated with sulfite chemical during the initial mechanical attrition step.

TABLE 1a

| | Control | | | |
|---|---|---|---|---|
| % Sulfur (bound) | 0 | 0 | 0 | 0 |
| Yield (%) | 91.4 | 95.1 | 96.6 | ≃100 |
| Freeness (CSF) | 169 | 279 | 347 | 562 |
| Burst Strength (% mullen) | 34.0 | 30.0 | 25.5 | 17.2 |
| Average Classified Fiber Length (CFL) (mm) | 1.45 | — | 1.61 | 1.76 |

TABLE 1b

| | | | | |
|---|---|---|---|---|
| % Sulfur (bound) | 0.23 | → | → | → |
| Yield (%) | — | 94.5 | 93.4 | 90.7 |
| Freeness (CSF) | 223 | 378 | 520 | 640 |
| Burst Strength (% mullen) | 47.8 | 34.1 | 27.4 | 23.3 |
| CFL (mm) | 1.66 | 1.70 | — | 1.94 |

TABLE 1c

| | | | | |
|---|---|---|---|---|
| % Sulfur (bound) | 0.44 | → | → | → |
| Yield (%) | 94.1 | 98.0 | 93.2 | 87.2 |
| Freeness (CSF) | 215 | 335 | 438 | 564 |
| Burst Strength (% mullen) | 62.5 | 58.9 | 49.7 | 42.3 |
| CFL (mm) | 1.80 | 1.79 | 1.87 | 1.96 |

TABLE 1d

| | Control | | |
|---|---|---|---|
| Freeness (CSF) | 679 | 487 | 439 |
| Yield (%) | 94.5 | 97.4 | 97.7 |
| Burst Strength (% mullen) | 8.0 | 11.8 | 14.3 |
| CFL (mm) | 1.60 | 1.52 | 1.44 |
| % Sulfur (bound) | 0 | 0 | 0 |

TABLE 1e

| | | | |
|---|---|---|---|
| Freeness (CSF) | 723 | 601 | 428 |
| Yield (%) | — | 92.7 | 93.3 |
| Burst Strength (% mullen) | 8.5 | 17.9 | 30.0 |
| CFL (mm) | 1.95 | 1.77 | 1.71 |
| % Sulfur (bound) | 0.18 | → | → |

TABLE 1f

| | | | | |
|---|---|---|---|---|
| Freeness (CSF) | 564 | 564 | 286 | 286 |
| Weight % Chemical pulp: SMTMP | 50:50 | 40:60 | 30:70 | 50:50 |
| Burst Strength (% mullen) | 97.9 | 87.7 | 91.4 | 111.0 |

At a freeness of 450 CSF, the increase in percent mullen ranged from about 51% (0.18% S) to about 128% (0.44% S), respectively, for the pulp treated with sulfite according to the process of this invention as compared with its untreated counterpart.

As shown in Table 1*f*, linerboard composition can be produced employing replacement quantities of SMTMP (greater than about 25% by weight) which exhibit the bursting strength required by commercial standards (greater than 80% mullen).

EXAMPLE 2

Experimental runs were also conducted in which a thermomechanical pulp (TMP) was first prepared by mechanical attrition at high temperature and pressure, followed by post-sulfonation of the thermomechanical pulp by cooking same in an aqueous medium containing a sulfite. More specifically, Douglas-fir chips were subjected to the action of a Bauer double-disc pressurized refiner equipped with CCW 36104 plates at a steam pressure of 75 psi (153° C.). The TMP was sulfonated by cooking same in a rotating digester with sodium sulfite at 116° C. per 25 minutes to produce an average yield of about 90%. After the post-sulfonation treatment is completed, the pulp is refined in a Bauer 415 atmospheric pressure refiner and then subjected to hot-disintegration in the manner previously described in Example 1 to form SMTMP. These results were compared to the same pulp without post-sulfonation treatment. The results of these runs were tabulated in Table 2 and pictorially described in FIG. 2.

TABLE 2

| | Control | | |
|---|---|---|---|
| Canadian Standard Freeness (CSF) | 707 | 583 | 390 |
| Burst Strength (% mullen) | 16.4 | 28.2 | 37.1 |

TABLE 2a

| | | | |
|---|---|---|---|
| Canadian Standard Freeness (CSF) | 499 | 422 | 215 |
| Burst Strength (% mullen) | 43.6 | 48.5 | 54.6 |

Figures 2, 2A:
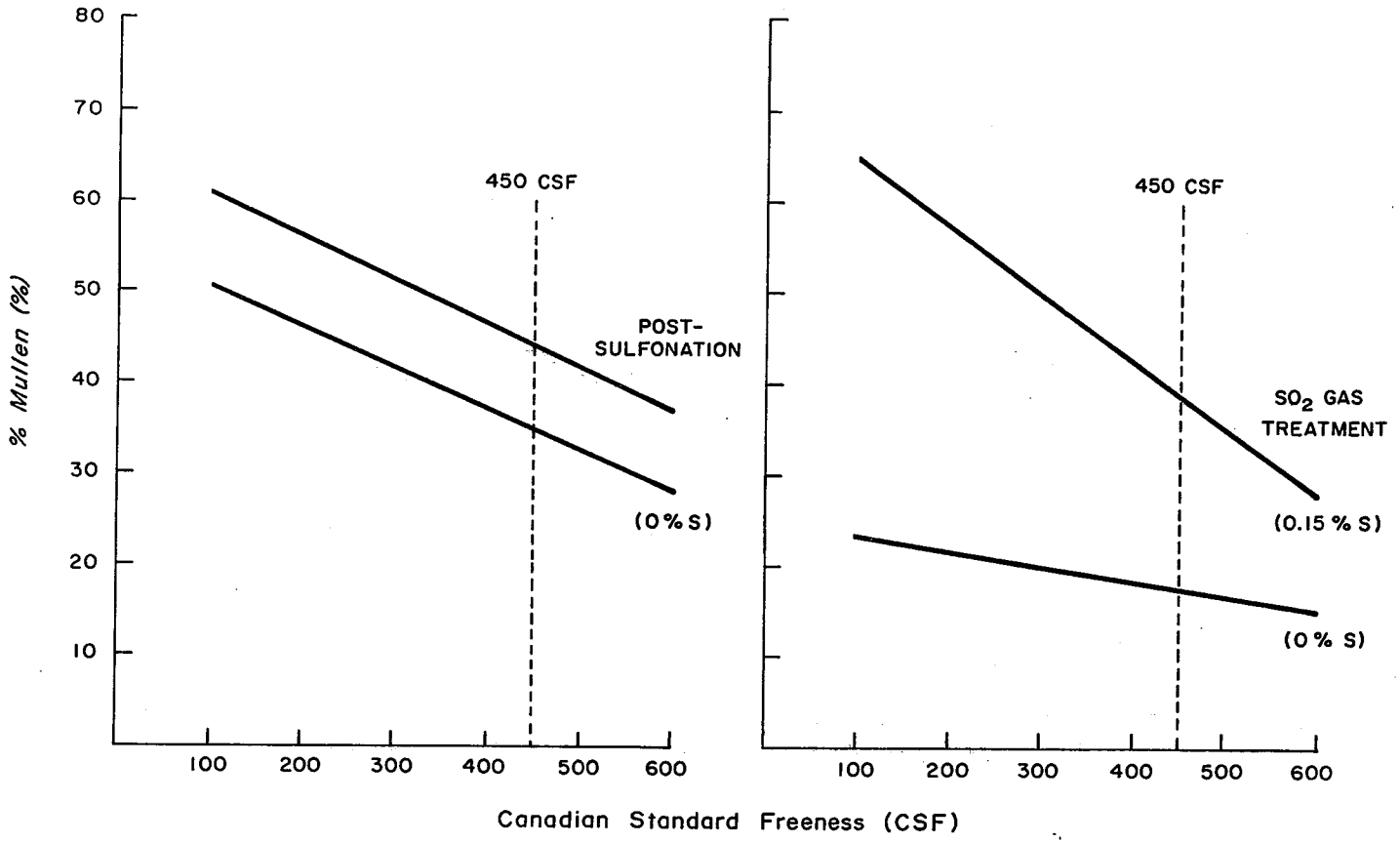
FIGS. 2 and 2A are graphical representations of the strength versus freeness relationships for SMTMP produced by post-sulfonation and $SO_2$ gas treatment techniques, respectively, as compared to their untreated counterparts (see Examples 2 and 3).

From an examination of the data in Tables 2 and 2*a*, as well as the graphic representation in FIG. 2, it is clear that a significantly high bursting strength (about 28% at a freeness of 450 CSF) is achieved by employing the above described post-sulfonation technique to produce the SMTMP of the present invention as compared to thermomechanical pulp which has not undergone sulfite treatment.

EXAMPLE 3

These experiments were conducted to demonstrate that the requisite linerboard compositions can be produced employing SMTMP prepared by sulfite treatment with $SO_2$, in this case gaseous modification with $SO_2$, of the thermomechanical pulp.

Lignocellulose, in the form of Southern pine chips, which had been subjected to thermomechanical treatment at a temperature above the lignin glass transition temperature (153° C.) at about 19 HPD/T, was combined with water and sodium carbonate and the consistency adjusted to about 30%. This is equivalent to about 4.7% by weight sodium carbonate. The high-consistency carbonate-treated pulp was added to a pressure vessel, warmed to a temperature of about 114° C. under pressure, and subjected to a stoichiometric amount of $SO_2$ gas. A sulfonation reaction was then conducted at 116° C. for 25 minutes. An amount of sodium sulfite equivalent to about 5.6% by weight was formed in situ by the above reaction. The sulfite-treated pulp was removed from the reaction vessel, washed thoroughly to remove the sodium sulfite and any excess free $SO_2$, neutralized with sodium carbonate and centrifuged to a consistency of about 35–40%. The pulp was then subjected to a high-consistency refining at atmospheric temperature and pressure to produce SMTMP (see Table 3*a*).

The counterpart of the above SMTMP without $SO_2$ treatment (see Table 3) required 84.2 HPD/T to achieve a freeness of 573 CSF. However, when a total of 85.2 HPD/T was imparted to the SMTMP, the freeness of 372 CSF was provided. This clearly shows that sulfite treatment enhances the processability of the lignocellulose and permits pulp to be produced at a given freeness level with significantly less power and correspondingly with significantly less fiber damage. The data from the above experiment runs in which 42No./1,000 $ft^2$ handsheets were tested is as follows:

TABLE 3

| | Control | | |
|---|---|---|---|
| % Sulfur (bound) | 0 | → | → |
| Freeness (CSF) | 681 | 573 | 423 |
| Burst Strength (% mullen) | 9.9 | 15.6 | 20.8 |

TABLE 3a

| | | |
|---|---|---|
| % Sulfur (bound) | 0.15 | → |
| Freeness (CSF) | 533 | 372 |
| Burst Strength (% mullen) | 33.1 | 46.0 |

Therefore, it can be readily seen in FIG. 2A that a much higher level of burst strength (about 120% higher at 450 CSF) can be achieved with in situ sodium sulfite treatment according to the process of this invention employing $SO_2$ gas than with a correspondingly untreated thermomechanical pulp.

We claim:

1. A linerboard composition having a percent mullen of at least 80%, which includes at least 25% by weight of a sulfite-modified thermomechanical pulp having a yield of at least 85% by weight, a percent bound sulfur level of at least about 0.15% by weight, based on the total weight of lignocellulose employed in producing said sulfite-modified pulp.

2. The linerboard composition of claim 1, which includes at least 30% by weight of said sulfite-modified thermomechanical pulp.

3. The linerboard composition of claim 1, wherein said percent bound sulfur level is at least about 0.25% by weight.

4. The linerboard composition of claim 3, wherein said percent bound sulfur is at least about 0.40% by weight.

5. The linerboard composition of claim 1, wherein said sulfite-modified thermomechanical pulp has a yield of at least 90% by weight.

6. The linerboard composition of claim 1, which includes at least 40% by weight of said sulfite-modified thermomechanical pulp.

7. The linerboard composition of claim 1, wherein the weighted average fiber length of the sulfite-modified thermomechanical pulp is at least 1.4 millimeters.

8. The linerboard composition of claim 7, wherein the weighted average fiber length is at least 1.6 millimeters.

9. The linerboard composition of claim 1, wherein dry-strength additives are incorporated in said sulfite-modified pulp to further increase the burst strength of the linerboard sheet.

10. The linerboard composition of claim 9, wherein at least about 0.05% by weight of dry-strength additive, based on the total weight of pulp in the furnish, is combined with the sulfite-modified thermomechanical pulp.

11. The linerboard composition of claim 1, wherein said sulfite-modified thermomechanical pulp is combined with up to about 75% by weight chemical pulp.

12. A process for producing a linerboard composition having a percent mullen of at least 80%, including a replacement quantity of sulfite-modified thermomechanical pulp, which comprises:

(a) initially imparting mechanical attritional forces to undefibered lignocellulose which has been subjected to an elevated temperature and corresponding pressure for a residence time period sufficient to soften the lignin portion of the lignocellulose causing substantial fiber separation to occur in the middle lamella layer so that the fibers remain essentially intact with a lignin coating on their outer surfaces, the power imparted to said undefibered lignocellulose by said initial mechanical attritional forces being sufficient to provide said substantial fiber separation without causing significant disassembly of the cellulose layers which form the fibers themselves;

(b) adding a sulfite chemical to the lignocellulose prior to, during, or subsequent to said initial mechanical attrition step so that a substantial quantity of carbon-to-sulfur covalent bonds are created when the sulfite interacts with the lignin, the degree of sulfonation being controlled in a manner adequate to produce sulfite-modified thermomechanical pulp having a percent bound sulfur level of at least about 0.15% by weight, based on the total weight of lignocellulose employed in producing said sulfite-modified pulp, while at the same time preventing dissipation of the lignin content of the sulfite-modified thermomechanical pulp to the point where the yield is detrimentally affected;

(c) subjecting said sulfite-treated lignocellulose to a second mechanical attrition step, conducted at substantially atmospheric temperature and pressure conditions, to produce a sulfite-modified thermomechanical pulp having a yield of at least about 85% by weight, the average fiber length of the undefiberized lignocellulose being substantially maintained on formation of the sulfite-modified thermomechanical pulp to facilitate the maintenance of a critical bursting strength level;

(d) forming an aqueous linerboard furnish, including at least about 25% by weight of said sulfite-modified thermomechanical pulp, capable of being formed into linerboard having a percent mullen of at least about 80%, without altering the ability of the furnish to properly drain;

(e) depositing said furnish on a foraminous surface to produce a wet linerboard web; and (f) drying said linerboard web.

13. The process of claim 12, wherein the Canadian Standard Freeness of the furnish is from about 150 CSF to about 650 CSF.

14. The process of claim 12, wherein said linerboard composition includes at least about 30% by weight of said sulfite-modified thermomechanical pulp.

15. The process of claim 12, wherein said sulfite-modified thermomechanical pulp has a percent bound sulfur of at least about 0.25% by weight.

16. The process of claim 15, wherein said percent bound sulfur is at least about 0.40% by weight.

17. The process of claim 12, wherein said sulfite-modified thermomechanical pulp has a yield of at least about 90% by weight.

18. The process of claim 17, wherein said linerboard composition includes at least about 40% by weight of said sulfite-modified thermomechanical pulp.

19. The process of claim 12, wherein the weighted average fiber length of the sulfite-modified thermomechanical pulp is at least about 1.4 millimeters.

20. The process of claim 12, wherein sulfite-modified thermomechanical pulp is combined with up to about 75% by weight chemical pulp.

21. The process of claim 12, wherein sulfur dioxide, in gaseous or liquid form, is added to said lignocellulose subsequent to said initial mechanical attrition step, but prior to further mechanical attrition.

22. The process of claim 12, wherein alkaline pH conditions are maintained during said initial mechanical attrition step.

23. The process of claim 22, wherein said pH is maintained at a pH of at least about 8 up to a pH of about 11.

24. The process of claim 12, wherein the undefibered lignocellulose is subjected to a pressure of at least about 30 psia for a residence time period of at least about 1.5 minutes.

25. The process of claim 24, wherein the residence time period is limited to about 5 minutes.

26. The process of claim 24, wherein the pressure is at least about 50 psia and the residence time is at least about 2.0 minutes.

27. The process of claim 26, wherein the residence time is limited to about 4 minutes.

28. The process of claim 12, wherein the power imparted to the undefibered lignocellulose during the initial mechanical treatment is less than about 50 HPD/T.

29. The process of claim 12, wherein the second mechanical attrition step is conducted at a lignocellulose consistency level of from about 20% by weight up to about 35% by weight.

* * * * *